US005385272A

United States Patent [19]

Aoun

[11] Patent Number: 5,385,272

[45] Date of Patent: Jan. 31, 1995

[54] BOTTOM DISPENSING DISPENSER

[76] Inventor: Michel M. Aoun, 156 Pleasant St., Attleboro, Mass. 02703

[21] Appl. No.: 33,531

[22] Filed: Mar. 18, 1993

[51] Int. Cl.[6] ..... B05B 9/04

[52] U.S. Cl. ..... 222/185; 222/213; 222/559

[58] Field of Search ..... 222/213, 212, 214, 181, 222/185, 559

[56] References Cited

U.S. PATENT DOCUMENTS

| | | | |
|---|---|---|---|
| 1,583,813 | 5/1926 | Thwaites | 222/213 |
| 2,927,717 | 3/1960 | McDermott | 222/213 |
| 3,368,722 | 2/1968 | Wallace | 222/214 |
| 3,926,347 | 12/1975 | Low et al. | 222/214 X |
| 4,258,865 | 3/1981 | Vahl et al. | 222/214 X |
| 4,324,348 | 4/1982 | Johnson et al. | 222/214 X |
| 4,463,876 | 8/1984 | Swallert | 222/214 X |
| 4,667,854 | 5/1987 | McDermott et al. | 222/213 X |
| 4,715,517 | 12/1987 | Potter et al. | 222/214 X |
| 4,932,562 | 6/1990 | Christine | 222/214 X |
| 4,961,508 | 10/1990 | Weimer et al. | 222/214 X |

*Primary Examiner*—Andres Kashnikow
*Assistant Examiner*—Kenneth DeRosa

[57] ABSTRACT

A hand held, free standing, bottom dispensing dispenser, generally made of plastic, for the dispensing of thick liquids such as lotions, shampoos, and processed foodstuff, having a resiliently walled reservoir that sits atop a stand that offers fulcrum for a mechanical linkage. The linkage has a top portion engaged to the reservoir side wall allowing the user's hand to grasp and manipulate the linkage while grasping and manipulating the reservoir, and a bottom portion coupled to dispensing valve disposed and adapted to open and close a discharge element affixed to an outlet in the bottom end of the reservoir. Thus, when hand pressure is applied to the linkage top portion at the same time the reservoir is squeezed and the motion transmitted by the linkage to the dispensing valve opens the latter to dispense a portion of the content. When pressure is relieved, the resilient reservoir side wall rebounds back to its initial shape and, the reservoir side wall being engaged to the linkage moves the latter back to its initial position. Thus while causing the dispensing valve to gradually close, the reservoir side wall outward movement induces in the reservoir an air flow that draws the fluid in the discharge element in therewith. The dispenser content is always located in the lower part of the reservoir near its aperture, ready to be dispensed, therefore making possible the dispensing of virtually all the content.

3 Claims, 5 Drawing Sheets

FIG. 7
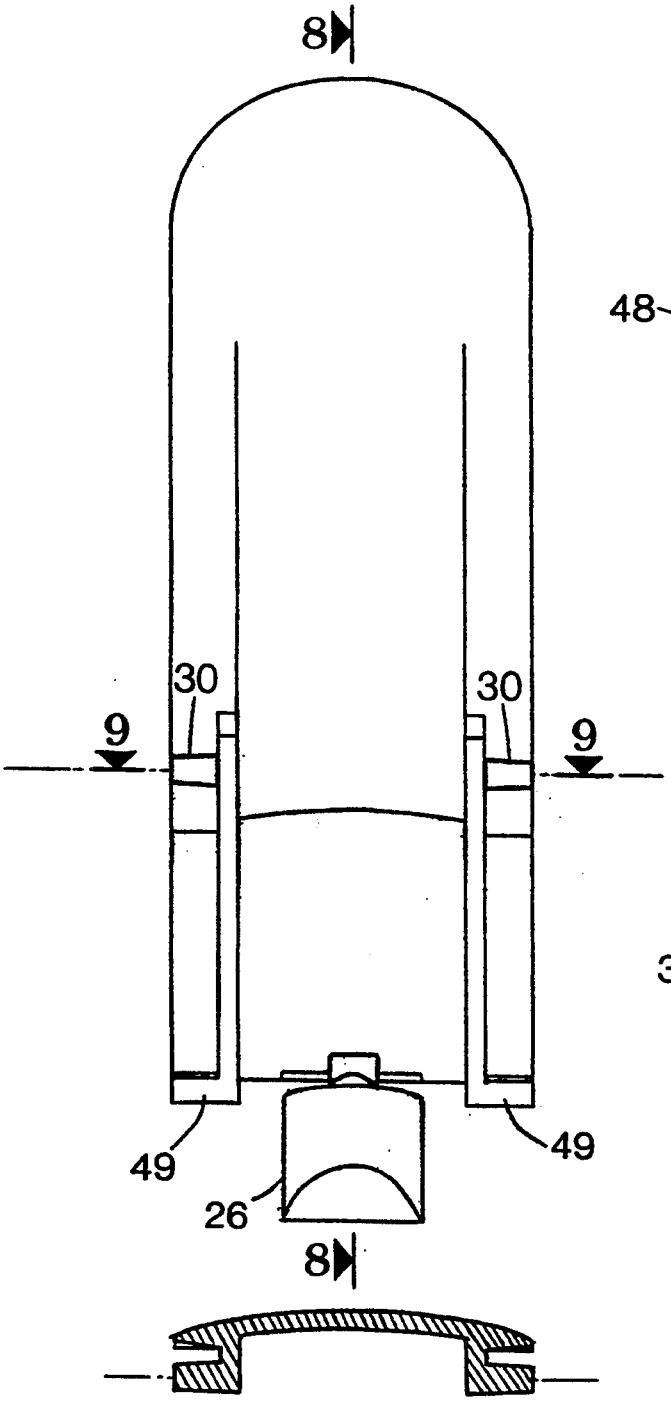
FIG. 8
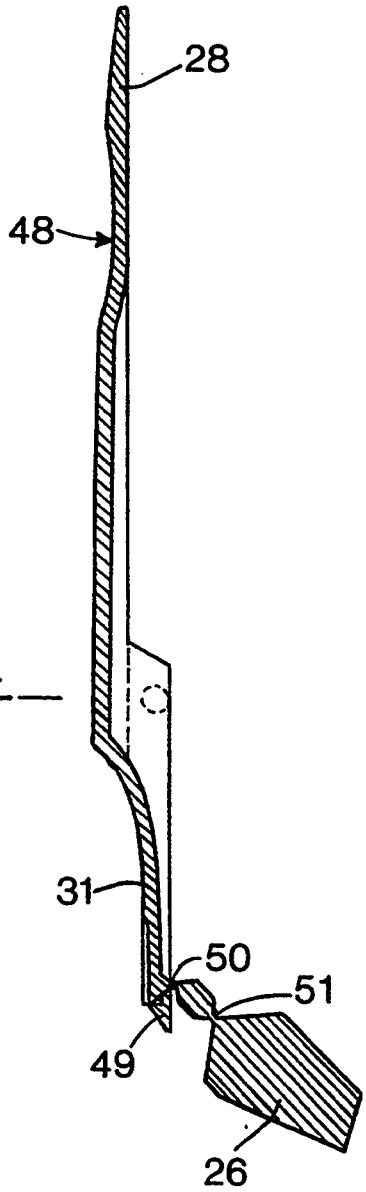
FIG. 9

BOTTOM DISPENSING DISPENSER

BACKGROUND OF THE INVENTION

This invention relates generally to hand held disposable dispensers for the dispensing of thick liquids, such as cosmetic products or processed foodstuff such as honey, mustard, and the like.

U.S. Pat. No. 5,037,005 describes a dispensing container of the above type in which a valved outlet located in the bottom of the container also incorporates an air venting aperture for admitting atmospheric air subsequent to the dispensing of the product. The dispensing valve is deflectable upon application of manual pressure on the container, and the fluid flows through and is channeled toward the external outlet. A partially rotatable cap with a pair of parallel abutment plates serve to lock the dispensing valve in the closed position, while in the open position the same abutment plates are supposed to channel the fluid toward the external outlet. One drawback of this type of arrangement is the permanently open venting aperture from which the fluid is likely to leak when handling or displacing the container. A further drawback is the consequence of the use of a deflectable dispensing valve of the type described in the related drawings, whose form and movement dictate a dispensing chamber with an indefinite form, having many cavities which will most likely be filled with fluid which will eventually dry up, thus obstructing the operation of the dispensing mechanism.

SUMMARY OF THE INVENTION

It is an object of the invention to provide an improved dispenser of the above described type, which is more effective and more convenient in operation.

Another object of the invention is to provide an improved dispenser with dispensing means that allows all its content to be completely discharged.

It is also an object of the invention to provide such an improved dispenser which requires relatively a minimum force for operation and to be used with the same maneuver until complete discharge of the content.

A further object of the invention is to provide a disposable dispenser with a minimum number of parts and a relatively simple design that achieves the aforementioned objects with the least possible cost.

In keeping with these objects there is provided, according to the present invention, a hand held free standing bottom dispensing dispenser, generally made of plastic, comprising a reservoir with a resilient side wall, and a mechanical linkage that has a top portion engaged to the dispenser reservoir side wall, allowing the user's hand to grasp and manipulate said top portion while grasping and manipulating the dispenser reservoir side wall, and a bottom portion coupled to a dispensing valve located at the bottom end of the reservoir. Thus when hand pressure is applied to the linkage top portion and the reservoir side wall simultaneously, the dispensing valve connected to the linkage bottom portion moves outward to an open position resulting in fluid discharge. Reversely, when hand pressure is relieved, the linkage top portion, being in permanent contact with the reservoir side wall, is urged by the rebounding reservoir side wall to return to its initial position thus closing the dispensing valve.

In the preferred embodiment, the dispenser is provided with a discharged element having a top portion in a sealing engagement with the reservoir aperture, and a bottom portion ending in an outlet aperture through which the content is discharged in response to hand pressure. A valve is disposed and adapted to open and close said discharge element, and is attached to the mechanical linkage bottom portion.

The preferred embodiment of the invention also incorporates a stand for the reservoir, to allow free standing of the dispenser. In this embodiment, then stand also provides fulcrum for the linkage.

In a practical elaboration of the present invention, a stiffening rib is incorporated in the reservoir wall to constrain it to reassume its normal shape after dispensing of the product. The stiffening rib is in the form of one or more corrugated folds, near the point of application of hand pressure to reservoir.

In a further embodiment, the dispenser is provided with a sliding dispensing valve, a tubing adapted to the discharge element and perpendicular to the fluid flow, provides housing for said valve.

In another practical embodiment of the present invention the outlet aperture of the discharge element is fitted to an opening in the dispenser stand, this opening is provided with a cover flexibly connected to the stand, this cover is engageable with the mechanical linkage bottom portion, and when closed locks said linkage and consequently the dispensing valve in closed position.

Because the linkage top portion rests on the dispenser reservoir side wall and is not attached to it, pressing on said linkage top portion and consequently on the reservoir is the only way to open the dispensing valve and dispense the fluid, therefore any pressure on the reservoir not engaging the mechanical linkage top portion should not produce any fluid discharge. More over, upon relieving the pressure on the discharge reservoir, the resilient reservoir side wail springs back to its normal position, thus to compensate the dispensed fluid volume, the dispenser sucks back a part of the fluid remaining in the discharged element and atmospheric air. Because of the mechanical linkage between reservoir and dispensing valve, the valve closes only when the reservoir regains its normal shape.

BRIEF DESCRIPTION OF THE DRAWINGS

FIG. 7 is an enlarged detailed rear view of a dispenser mechanical linkage;

FIG. 8 is a section taken at 8—8 of FIG. 7;

FIG. 9 is a section taken at 9—9 of FIG. 7;

DESCRIPTION OF THE PREFERRED EMBODIMENTS

Figure 1:
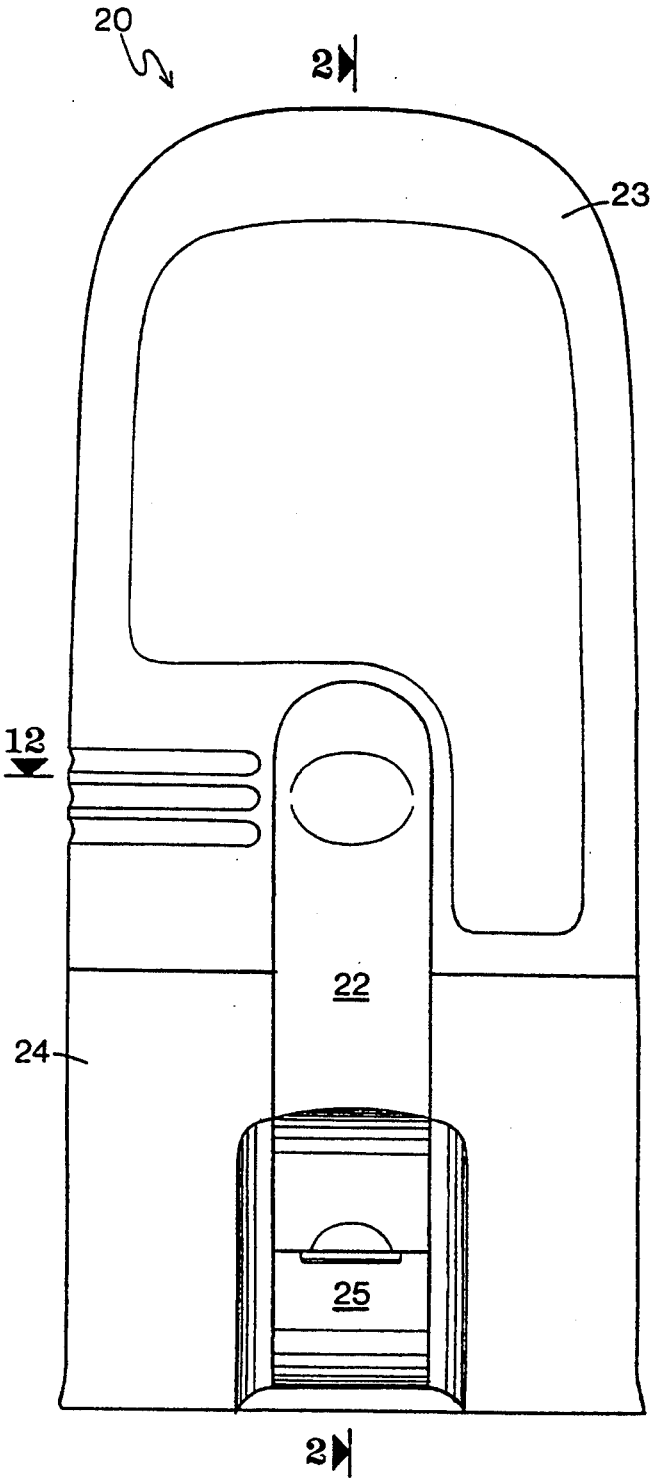
FIG. 1 is a front elevation of one embodiment of the dispenser in accordance with the present invention.

A bottom dispensing dispenser 20 is depicted in FIGS. 1, 2, 3A, and 3B; the dispenser has a reservoir 23, a stand 24, a discharge element 27 attached to the reservoir neck 35, and a corresponding dispensing valve 26. The dispensing valve 26 in this embodiment for the subject invention slides inside the discharge element 27, and is flexibly connected to the bottom portion 31 of a mechanical linkage 22. The mechanical linkage 22 has a top portion 28 in permanent contact with the reservoir side wall at 29, and is pivotably mounted on the dispenser stand 24.

Figure 2:
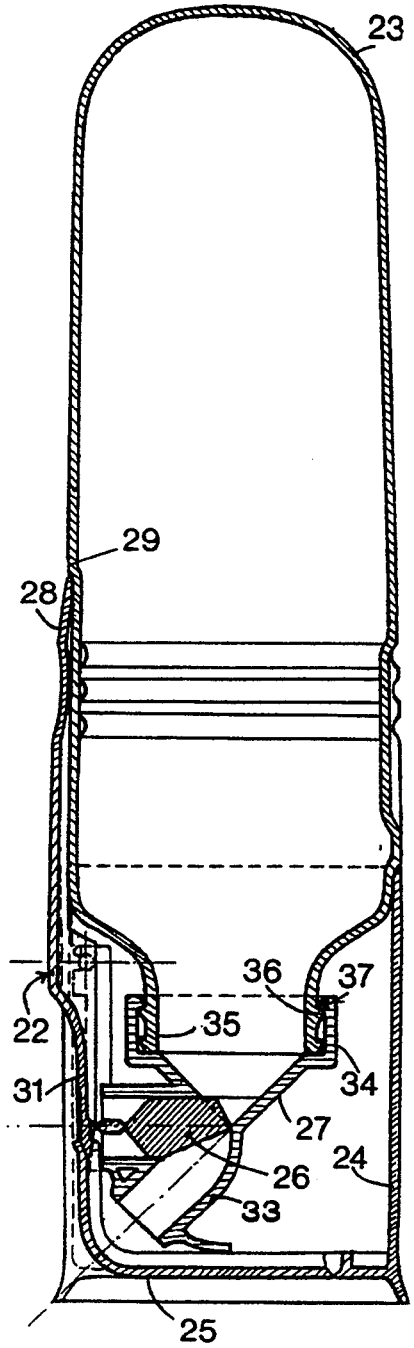
FIG. 2 is a side sectional elevation taken at 2—2 of FIG. 1.
Figure 3A:
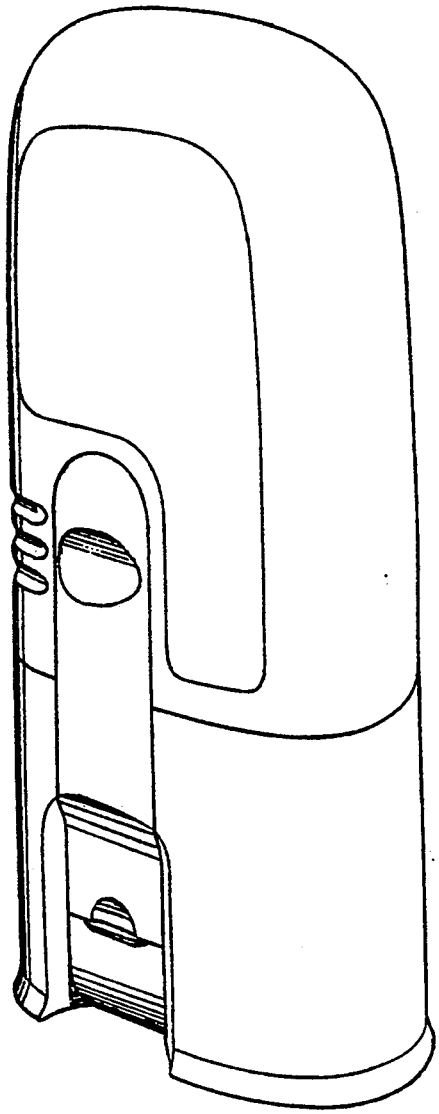
FIG. 3A is a perspective view of the dispenser shown in FIGS. 1 and 2, in a closed position.
Figure 3B:
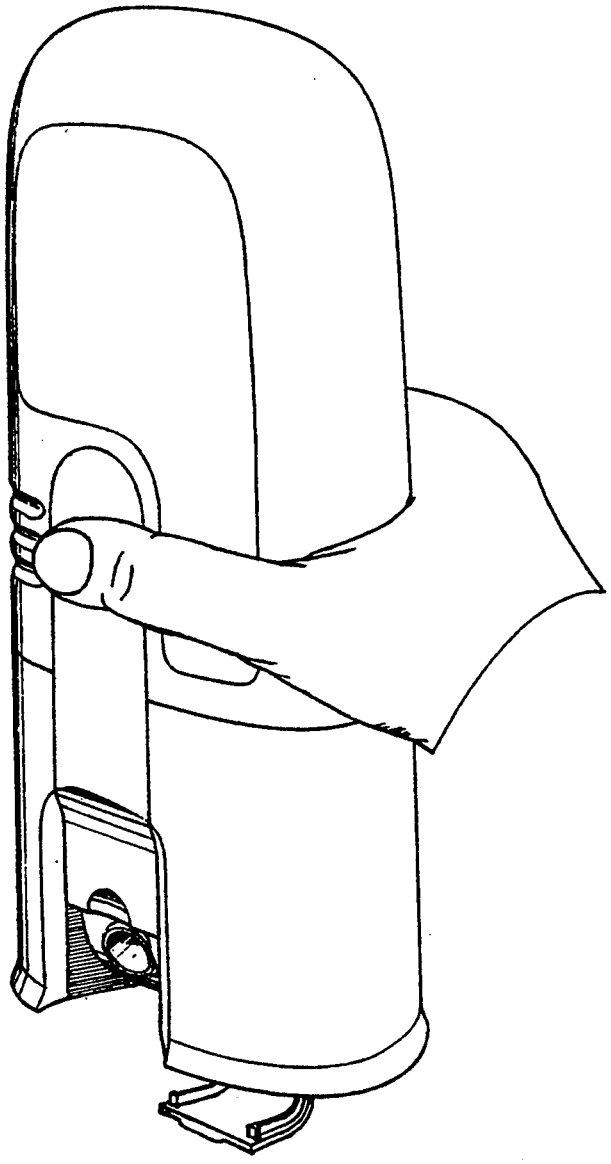
FIG. 3B is a like view with the dispenser in a dispensing position, showing the normal manner of handling the dispenser.
Figure 12:
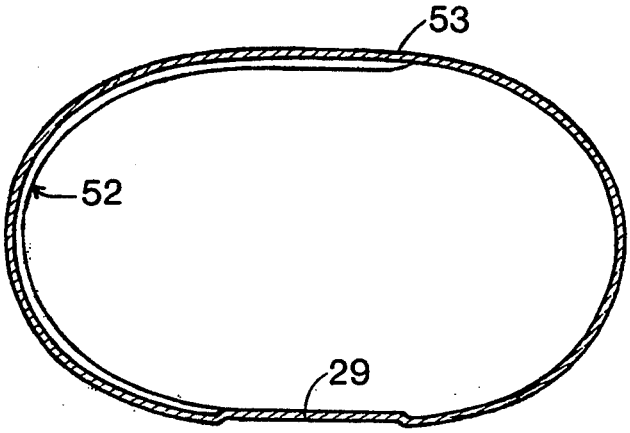
FIG. 12 is a section taken at 12—12 of FIG. 1.

When grasping the dispenser 20 in a way that engages the mechanical linkage top portion 28, as seen in FIG. 3B, and applying hand pressure, the dispenser reservoir 23 is squeezed and the linkage 22 is actuated, thus the linkage top portion 28 moves inward while its bottom portion 31 and the dispensing valve 26 move outward, opening the discharge element 27 and resulting in fluid discharge. When the desired amount fluid is dispensed and the pressure on the reservoir is relieved, the reservoir 23 rebounds back to its normal shaped while displacing the mechanical linkage top portion 28 and consequently its bottom portion 31 and the dispensing valve 26 back to their initial positions, thus gradually closing the discharge element 27, which will be closed only when the mechanical linkage 22 and the reservoir 23 return back to their initial state. Stiffening ribs 52 are incorporated in the reservoir side wall 29 to insure that the reservoir 23 will always regain its shape after use. In the embodiment of FIGS. 1–3B, the ribs 52 start near the point of application of hand pressure to the reservoir side wall 29, and extend to an opposite point 53, as shown in FIG. 12.

Figure 4:
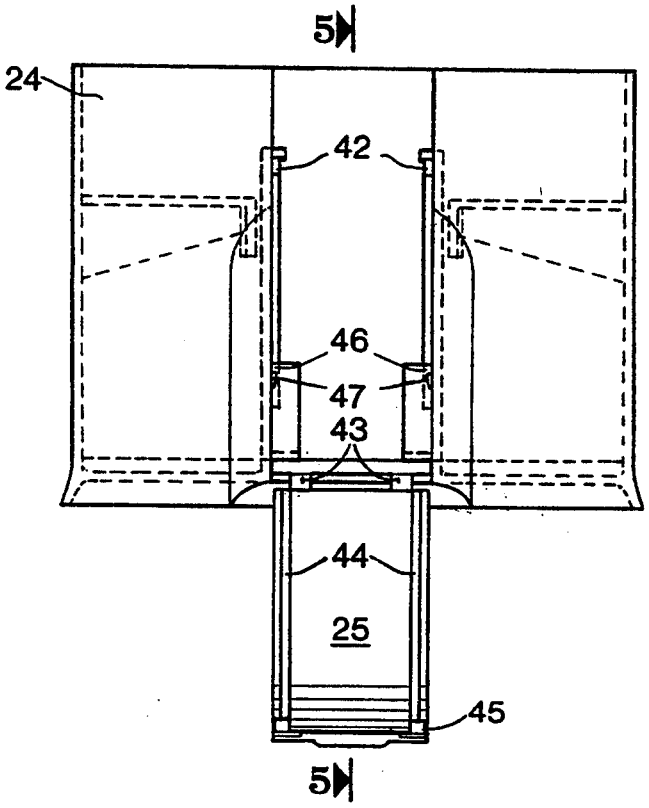
FIG. 4 is a front view of a dispenser stand.
Figure 5:
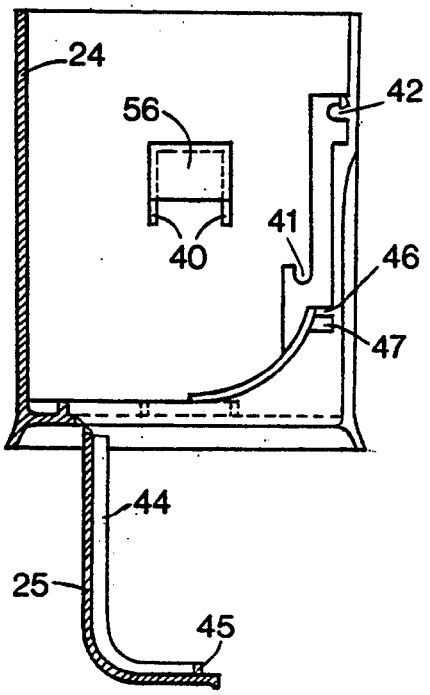
FIG. 5 is a sectional view taken at 5—5 of FIG. 4.
Figure 6:
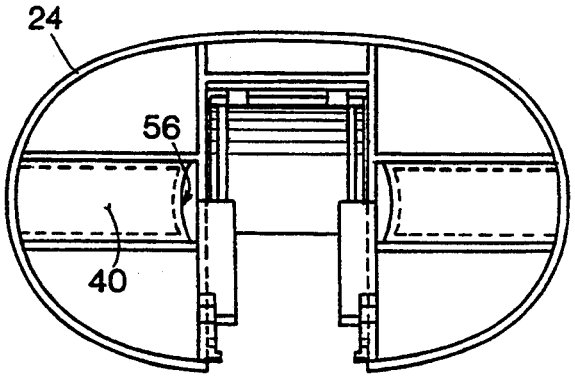
FIG. 6 is a top view of the stand of FIG. 5.
Figure 13:
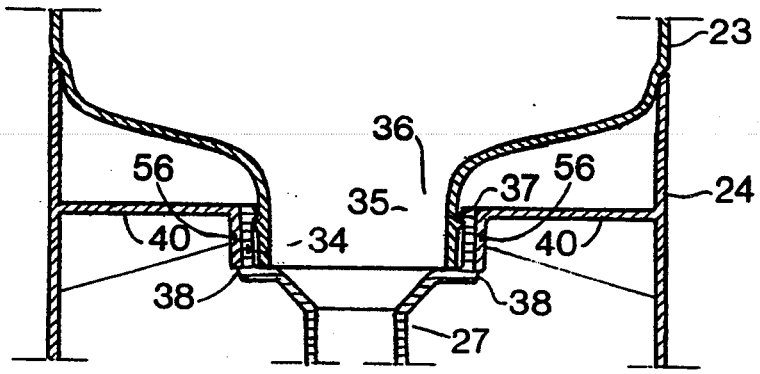
FIG. 13 is a section taken at the reservoir neck.

A stand 24 shown in FIG. 4–6 offers support for reservoir 23 and includes two anchor arms 40 disposed symmetrically, and each ending in a curved plate 56. As seen in FIG. 13, Plates 56 engage to the discharge element 27, which in turn is secured to the reservoir neck 35. Thus by means of arms 40, the discharge element 27 and consequently the reservoir 23, are attached to the stand 24. A cover 25 is part of the stand 24, and is connected to the latter by two living hinges 43. The cover 25 has two symmetric ribs 44, and two minuscule pins 45 on the outer sides of ribs 44 ends. Once the cover 25 is closed, pins 45 go into two corresponding slots 46 in the dispenser stand 24. Stops 47 lock pins 45 in slots 46, thus locking cover 25 in a closed position.

The stand 24 also offers fulcrum for the mechanical linkage 22 shown in detail in FIGS. 7–9. The linkage 22 has two pivot pins 30 that fit into two slots 42 in the stand 24. A sliding valve 26 forms an extension of the mechanical linkage bottom portion 31. Two sectional reductions 50 and 51 keep a flexible connection between the linkage 22 and valve 26. As seen in FIG. 2, two symmetrical abutment plates 49 extend from the end of linkage bottom portion 31. When closed, cover 25 engages to plates 49 to prevent the outward movement of the linkage bottom portion 31 and the dispensing valve 26, thus locking the mechanical linkage 22 and the dispensing valve 26 in a closed position, and preventing any accidental discharge of the content.

Figure 10:
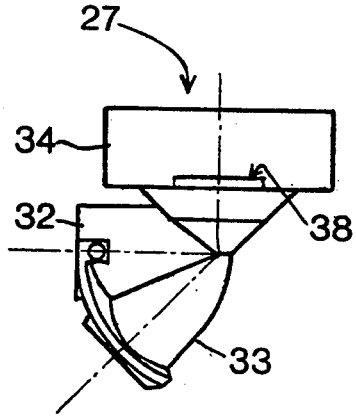
FIG. 10 is a side elevation of the discharge element of one embodiment of the dispenser.
Figure 11:
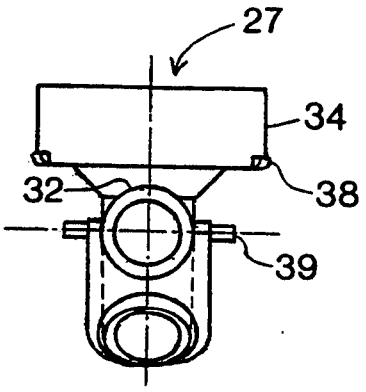
FIG. 11 is a front elevation of the discharge element shown in FIG. 10.

A discharge element 27 is shown in FIGS. 10 and 11. This embodiment has a collar 34 that secures the discharge element 27 to the reservoir neck 35. The collar 34 as shown in FIG. 2 has an attachment ring 37; a ring 36 around the reservoir neck 35 locks the collar 34 in. Two symmetrical ribs 38 on the outer surface of collar 34 engage to anchor arms 40, as shown in FIG. 13, to attach the discharge element 27 to the stand 24. The discharge element 27 ends with a tubing 33. Another tubing 32 intercepts between collar 34 and tubing 33 in a substantially horizontal position. Tubing 32 is the housing of the dispensing valve 26. Tubing 32 is provided with two pins 39, that slide in two corresponding slots 41 in the dispenser stand 24, as shown in FIG. 6. Thus any possible horizontal movement of the discharge element 27 during operation prevented.

I claim:

1. A bottom dispensing free standing hand held dispenser for viscid liquids, such as lotions and shampoos, comprising:

a manually squeezable reservoir generally made of a resilient plastic to preclude deformation of its original shape after manipulation, and having a side wall converging upwardly to a curved top portion, and a bottom portion ending in an aperture for the passage of liquid therethrough;

a discharge element for said reservoir having a top and bottom portions, said top portion having annular attachment means for securing said discharge element to said reservoir aperture in transverse arrangement thereacross in a liquid tight seal, said bottom portion terminating in a downwardly and forewardly projecting tubing, terminating in an outlet aperture;

a dispensing valve disposed and adapted to open and close said discharge element, normally in a first closed position and movable away to a second dispensing position;

a stand for said reservoir to allow free standing of the dispenser, having walls aligned with and supporting said reservoir side wall, said stand having anchoring means to secure said reservoir to the stand, said stand also incorporating an opening for accommodating said discharge element outlet aperture;

a mechanical linkage disposed and adapted to transmit movement of said reservoir side wall to said dispensing valve, said mechanical linkage having pivot means mounted on said stand and comprising a top portion engaged with said reservoir side wall and a bottom portion coupled with said dispensing valve, said mechanical linkage is so disposed to constrain said dispensing valve to synchronously move with said reservoir side wall, said dispensing valve being movable to said second dispensing position when said reservoir side wall is moved inward due to hand pressure acting on said reservoir side wall and said mechanical linkage top portion simultaneously, and to said first closed position urged by the rebounding movement of said reservoir side wall after relief of hand pressure, so that said dispensing valve closes only when said reservoir is back to its original shape.

2. A dispenser as defined in claim 1, wherein said dispensing valve is a sliding valve, having a circular cross section and a wedged head having a straight edge, said discharge element having a middle portion between top and bottom portions that includes a tubing that provides housing for said dispensing valve, said middle portion is connected to top portion through an aperture, when said dispensing valve is in said first closed position said valve wedged head engages to said aperture in a sealing relation thereacross.

3. A dispenser as defined in claim 1, wherein said discharge element outlet aperture has a cover carried by said stand, said cover is movable to close said discharge element outlet aperture and to engage with said mechanical linkage bottom portion locking said dispensing valve in said closed position, said cover being removable from engagement with said mechanical linkage bottom portion when said cover is moved to open said discharge element outlet aperture.

* * * * *